US005746451A

United States Patent [19]

Weyer

[11] Patent Number: 5,746,451

[45] Date of Patent: May 5, 1998

[54] CUSTOMIZABLE CREDIT CARD OVERLAY

[76] Inventor: Frank M. Weyer, 505 S. Beverly Dr. #1224, Beverly Hills, Calif. 90212

[21] Appl. No.: 703,991

[22] Filed: Aug. 28, 1996

Related U.S. Application Data

[60] Provisional application No. 60/003,182 Sep. 5, 1995.

[51] Int. Cl.[6] ..... B42D 15/00

[52] U.S. Cl. ..... 283/65; 283/904

[58] Field of Search ..... 283/904, 65, 72, 283/17

[56] References Cited

U.S. PATENT DOCUMENTS 3,505,954 4/1970 Projansky ..... 283/904 X 5,326,964 7/1994 Rissen ..... 283/904 X 5,608,203 3/1997 Finkelstein et al. ..... 283/904 X

*Primary Examiner*—Willmon Fridie, Jr.

[57] ABSTRACT

The present invention consists of an overlay for the front surfaces of credit, debit, ATM and similar transaction cards. The overlay is designed in such a manner that it allows the cardholder to customize the appearance of the front surface of the cardholder's cards without affecting the operability of the card. The overlay of the present invention may be easily fabricated with a number of designs, ranging from artistic designs, to personal photographs, to political, religious, humorous, or other messages. As such, the present invention allows a cardholder to customize and personalize the appearance of the cardholder's cards as well as to use the cards as a means to communicate ideas and messages in addition to acting as a means of payment whenever a card is used.

19 Claims, 3 Drawing Sheets

CUSTOMIZABLE CREDIT CARD OVERLAY

REFERENCE TO RELATED PATENT APPLICATION

This patent application is based on and is a continuation of provisional patent application Ser. No. 60/003,182 for "Customizable Credit Card Overlay" filed Sep. 5, 1995.

FIELD OF THE INVENTION

The present invention relates to the field of transaction cards such as credit cards, ATM cards, and the like, and more particularly to an overlay that allows a cardholder to customize the appearance of the cardholder's transaction cards without altering the card itself or affecting the card's operability.

BACKGROUND OF THE INVENTION

Millions of transaction cards such as credit cards, debit cards, and automatic teller machine ("ATM") cards are in use. These cards are plastic cards having a front and a reverse. FIG. 1 illustrates the front side of a typical card. As shown in FIG. 1, the front side commonly has a flat front surface 100 with designated regions 120 and 130*a–c* for embossed alphanumeric characters. In the card of FIG. 1, region 120 contains embossed alphanumeric characters identifying the cardholder's account number. In a similar manner, region 130*a* contains the cardholder's name, region 130*b* contains the effective dates of the card, and region 130*c* contains the cardholder's tax ID number. Most cards follow this same standardized format of designated regions, although the information contained in regions 130*a–c* may vary from that shown in FIG. 1, and not all regions are always used.

The background design of a card such as that shown in FIG. 1 is typically integrally molded with the surface of the card. The design often consists of a single background color, and, as shown in FIG. 1, contains a designated region for the logo of the issuer 140, typically along the top of the card, and a designated region for the logo of the credit organization 160 with which the card is associated, typically in the lower right hand corner. Many cards, including the card shown in FIG. 1, also contain a designated region 150 for a holographic image, which aids in preventing counterfeiting of the card.

FIG. 2 shows the reverse of the card of FIG. 1. As shown in FIG. 2, the reverse of the card usually contains a magnetic strip 200 on which information about the cardholder's account is encoded, as well as a signature space 210 intended for the cardholder's signature.

The designs and/or illustrations found on the front of the cards of a particular issuer are generally the same for all cardholders, except for differences in the embossed name, account number, and expiration date. Recently, some card issuers have given card holders the option of having a photo of the cardholder included in a particular location on the front of the card. This photo is molded into the card when it is fabricated, and is not an option that can be independently added by the cardholder. Other card issuers have recently begun offering cardholders a limited choice of designs for the front of the cards they issue. However, the choice is limited to those provided by the card issuer, and if the cardholder desires to change two a different one of the offered designs, the cardholder must request and pay for a new card.

Accordingly, currently there exist no means allowing a cardholder to individually customize the appearance of the front of the cardholders credit, debit, and ATM cards.

SUMMARY OF THE INVENTION

The present invention consists of an overlay for the front surfaces of credit, debit, ATM and similar transaction cards. The overlay is designed in such a manner that it allows the cardholder to customize the appearance of the front surface of the cardholder's cards without affecting the operability of the card. The overlay of the present invention may be easily fabricated with a number of designs, ranging from artistic designs, to personal photographs, to political, religious, humorous, or other messages. As such, the present invention allows a cardholder to customize and personalize the appearance of the cardholder's cards as well as to use the cards as a means to communicate ideas and messages in addition to acting as a means of payment whenever a card is used.

DETAILED DESCRIPTION OF THE INVENTION

Figure 1:
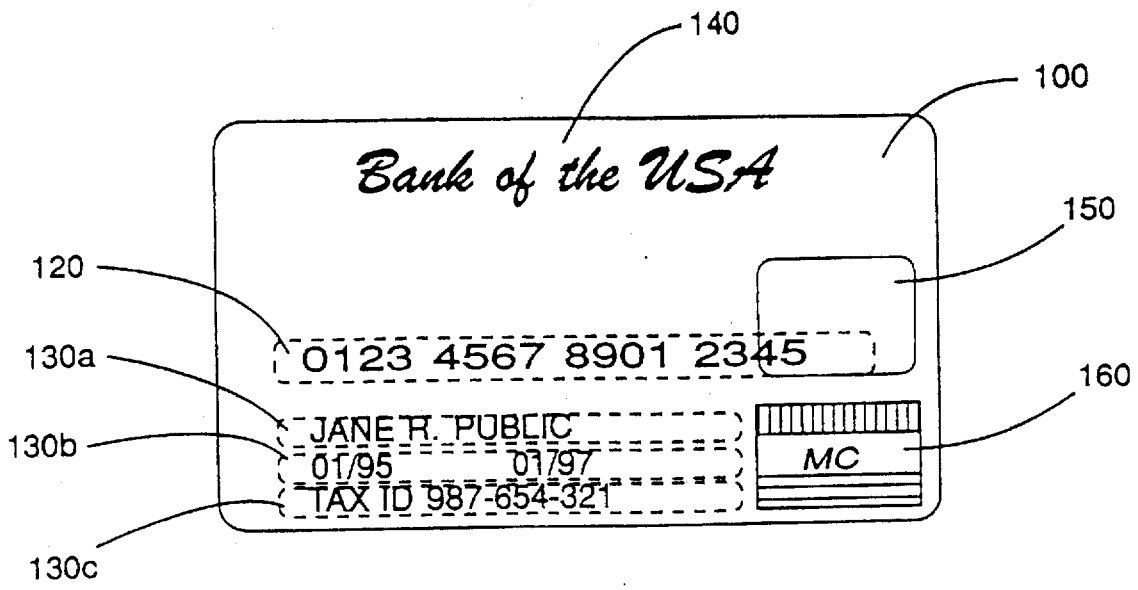
Figure 1 (Prior Art)
FIG. 1 is a front view of a typical credit card of the prior art.
Figure 2:
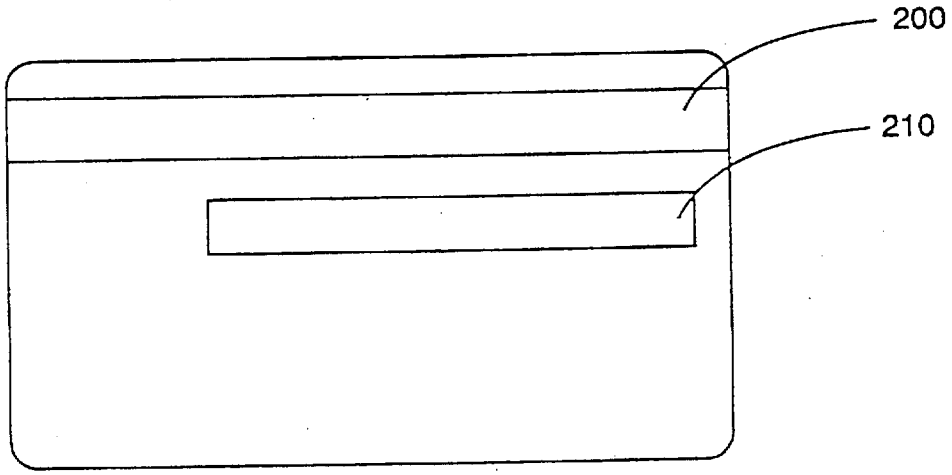
Figure 2 (Prior Art)
FIG. 2 is a reverse view of a credit card of the prior art.
Figure 3:
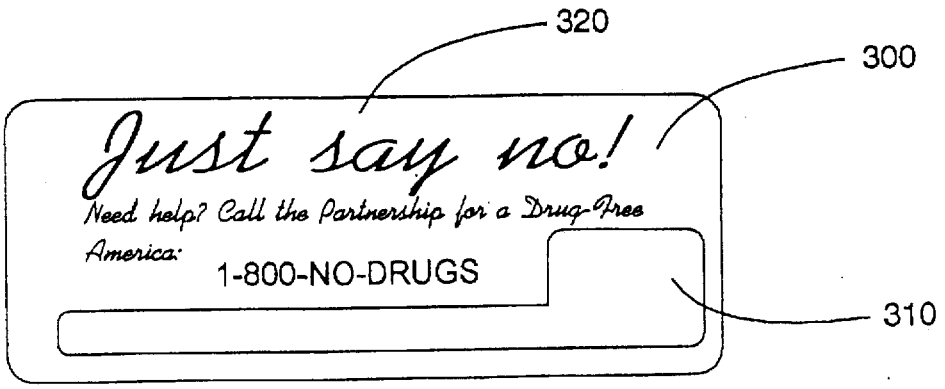
FIG. 3 is a front view of an embodiment of the present invention.

FIG. 3 is a front view of one embodiment of the credit card overlay 300 of the present invention. The embodiment shown in FIG. 3 consists of a thin film of adhesive backed vinyl, paper, mylar, or any other thin, adhesive backed material as is well known for use in adhesive bumper stickers, decals, labels, and the like. A number of different adhesives may be used, from very strong adhesives that make it difficult to remove overlay 300 after it has been affixed, to easily removable adhesives, such as, for example, the adhesive used on "Post-it" notes. In addition to adhesives, other means may be used to adhere overlay 300 to card 400. For example, overlay 300 may be made of a material that electrostaticly adheres to card 400. Overlay 300 may be transparent, translucent, opaque, or a combination.

Overlay 300 contains a cut-out region 310, and a message region 320. Message region 320 generally consists of all of the front surface of overlay 300 except for cut-out region 310. In the embodiment of FIG. 3, the message region 320 contains the public service message: "Just say no! Need help? Call the Partnership for a Drug Free America: 1-800-NO-DRUGS" However, message region 320 may contain any other message, or an illustration, a design, a photograph, or any other type or combination of graphic and/or textual design.

Figure 4:
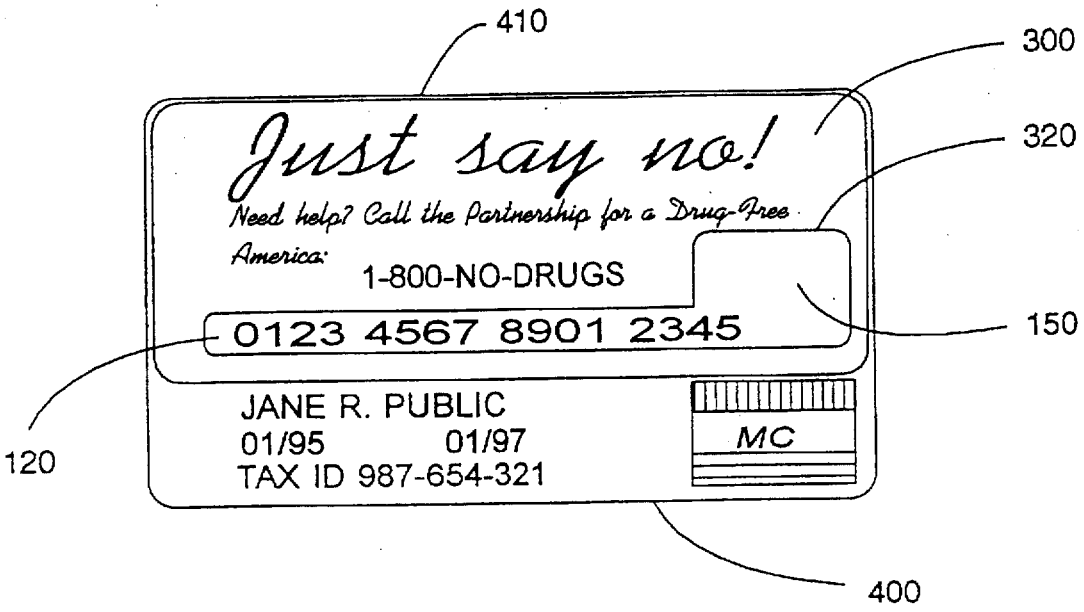
FIG. 4 is a front view of a credit card of the prior art to which an embodiment of the present invention has been affixed.

Overlay 300 and cut-out region 310 have the configurations and dimensions relative to a prior art credit card 400 as shown in FIG. 4 As shown in FIG. 4, the message region 320 of overly 300 is shaped and dimensioned such that when affixed to prior art credit card 400 as shown in FIG. 4, message region 320 overlays approximately the region of the credit card from its top edge 410 to somewhat below designated region 120. Cut-out region 310, on the other hand, is configured such that the cut-out overlays the designated region 120 of card 400 containing the cardholder's account number, and designated holographic region 150 of card 400. Accordingly, cut-out region 310 prevents overlay 300 from obscuring designated regions 120 and 150, thereby maintaining full functionality of the card, and allowing an unobstructed view of holographic region 150 as well.

Figure 5:
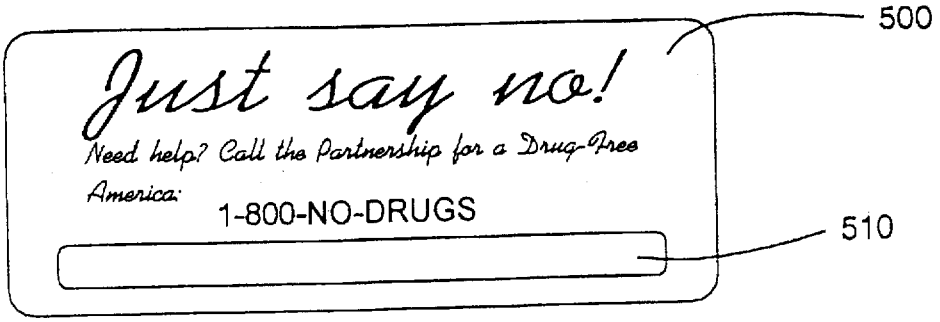
FIG. 5 is a front view of a second embodiment of the present invention.
Figure 6:
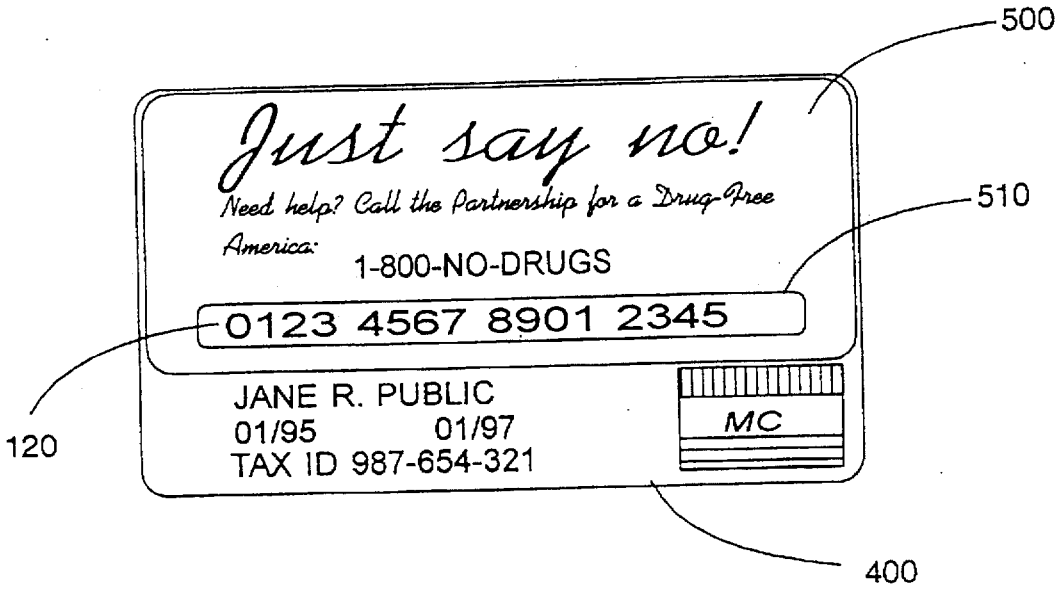
FIG. 6 is a front view of a credit card of the prior art to which a second embodiment of the present invention has been affixed.

FIGS. 5 and 6 show a second embodiment of an overlay of the present invention. In the embodiment of FIGS. 5 and 6, cut-out region 510 of overlay 500 corresponds only to designated region 120, not also to designated holographic region 150 as does cut-out region 310 of the embodiment of FIGS. 3 and 4.

Thus, a novel credit card overlay that allows a cardholder to independently customize the cardholder's card has been presented. It will be apparent to those skilled in the art that although specific designs and configurations have been presented as examples, other designs and configurations may be used for the present invention. For example, the overlay may contain multiple and or larger cut-out regions, and the cut-out regions may themselves be of any design or shape, as long as they allow full functionality of the card. The overlay may also be larger such that it overlays a greater part of the credit card, as long as it contains appropriate cut-outs so that information contained in the designated regions that is necessary for full functionality of the card is not inoperably obscured. Other designs, configurations, and embodiments of the present invention will be apparent to those skilled in the art.

I claim:

1. An overlay for affixing to a transaction card, said transaction card having a front surface and a first embossed region, said overlay comprising:

a bottom surface comprising means for adhering to said front surface of said transaction card, said means for adhering to said front surface of said transaction card comprising a contact adhesive;

a top surface comprising a message region;

a first cut-out region corresponding, when said overlay is affixed to said transaction card, to said first embossed region such that said first embossed region remains unobscured by said overlay and an operability of said transaction card is preserved.

2. The transaction card overlay of claim 1 wherein said message region comprises generally all of said top surface of said overlay excluding said first cut-out region.

3. The transaction card overlay of claim 1 wherein said message region comprises a graphic.

4. The transaction card overlay of claim 1 wherein said first embossed region comprises an embossed account number of said transaction card.

5. The transaction card overlay of claim 1 wherein said transaction card is a credit card.

6. The transaction card overlay of claim 1 wherein said transaction card is an ATM card.

7. The transaction card overlay of claim 1 wherein said means for adhering to said front surface of said transaction card allows said overlay to be removably affixed to said front surface of said transaction card.

8. The transaction card overlay of claim 1 wherein said transaction card comprises a holographic region and wherein said overlay comprises a second cut-out region corresponding, when said overlay is affixed to said front surface of said transaction card, to said holographic region such that said holographic region remains unobscured by said overlay.

9. The transaction card overlay of claim 1 wherein said overlay is comprised of paper.

10. The transaction card overlay of claim 1 wherein said overlay is comprised of a plastic.

11. An overlay for affixing to a transaction card, said transaction card having a front surface and a first embossed region, said overlay comprising:

a bottom surface comprising means for adhering to said front surface of said transaction card, said means for adhering to said front surface of said transaction card allowing said overlay to be removably affixed to said front surface of said transaction card, said means for adhering to said front surface of said transaction card comprising means for electrostatic attraction;

a top surface comprising a message region;

a first cut-out region corresponding, when said overlay is affixed to said transaction card, to said first embossed region such that said first embossed region remains unobscured by said overlay and an operability of said transaction card is preserved.

12. The transaction card overlay of claim 11 wherein said message region comprises generally all of said top surface of said overlay excluding said first cut-out region.

13. The transaction card overlay of claim 11 wherein said message region comprises a graphic.

14. The transaction card overlay of claim 11 wherein said first embossed region comprises an embossed account number of said transaction card.

15. The transaction card overlay of claim 11 wherein said transaction card is a credit card.

16. The transaction card overlay of claim 11 wherein said transaction card is an ATM card.

17. The transaction card overlay of claim 11 wherein said transaction card comprises a holographic region and wherein said overlay comprises a second cut-out region corresponding, when said overlay is affixed to said front surface of said transaction card, to said holographic region such that said holographic region remains unobscured by said overlay.

18. The transaction card overlay of claim 11 wherein said overlay is comprised of paper.

19. The transaction card overlay of claim 11 wherein said overlay is comprised of a plastic.

* * * * *